US005359304A

United States Patent [19]

Fujiki

[11] Patent Number: 5,359,304

[45] Date of Patent: Oct. 25, 1994

[54] CHIP TYPE DIRECTIONAL COUPLER

[75] Inventor: Yasuhiro Fujiki, Nagaokakyo, Japan

[73] Assignee: Murata Manufacturing Co., Ltd., Japan

[21] Appl. No.: 981,074

[22] Filed: Nov. 24, 1992

[30] Foreign Application Priority Data

Nov. 27, 1991 [JP] Japan ..... 3-312355

[51] Int. Cl.[5] ..... H01P 5/18

[52] U.S. Cl. ..... 333/116; 333/328

[58] Field of Search ..... 333/116

[56] References Cited

U.S. PATENT DOCUMENTS 3,562,674 2/1971 Gerst ..... 333/116
4,821,007 4/1989 Fields et al. ..... 333/116 X
4,823,097 4/1989 Konishi et al. ..... 333/116

*Primary Examiner*—Paul Gensler
*Attorney, Agent, or Firm*—Ostrolenk, Faber, Gerb & Soffen

[57] ABSTRACT

Disclosed herein is a chip type directional coupler comprising a laminated structure having two stripline electrode substrates, each provided with a quarter-wavelength stripline electrode portion meandered on one major surface thereof, which are so stacked as to electromagnetically couple the stripline electrodes with each other and two ground electrode substrates, provided with ground electrodes, which are stacked to hold the two stripline electrode substrates, and a plurality of external electrodes formed on side surfaces of the laminated structure. Respective end portions of the stripline electrodes and the ground electrodes are electrically connected to different ones of the external electrodes respectively.

16 Claims, 6 Drawing Sheets

CHIP TYPE DIRECTIONAL COUPLER

BACKGROUND OF THE INVENTION

1. Field of the Invention

The present invention relates to a chip type directional coupler employing striplines.

2. Description of the Background Art

In order to manufacture a waveguide circuit, which has been the mainstream of microwave circuits, highly precise machining is required. Therefore, such a waveguide circuit is unsuitable for mass production, high-priced, large-sized and weighty. In a communication device handling frequencies exceeding the UHF level, further, it is difficult to form passive elements such as coils and capacitors into a lumped parameter circuit, since these elements have extremely small values. In a radio set or a BS receiver, therefore, a high frequency circuit is generally formed by a distributed parameter circuit. Microstriplines and striplines, which can be readily implemented in small sizes are employed for forming such a distributed parameter circuit.

A directional coupler is a circuit element which is adapted to draw an output being proportional to only unidirectional power from microwave power flowing through a transmission line without reference to reverse power. FIG. 5 shows a conventional quarter-wavelength coupled-line directional coupler, which is formed by using stripline electrodes 40*a* and 41*a*. Referring to FIG. 5, stripline electrodes 40*a* and 41*a* partially approach each other in grade separation over a length of $\lambda/4$, where $\lambda$ represents a wavelength.

Due to the coupling mode of the portions approaching each other in grade separation over the aforementioned length of $\lambda/4$. A high frequency signal which is applied to the principal line through a port 1 appears on another port 2, while several-tenth power thereof simultaneously appears on a port 3 of the secondary line. It is possible to arbitrarily set the output level to the port 3 by changing the space between the striplines 40*a* and 41*a*. When the space between the striplines 40*a* and 41*a* is so set that the output level to the port 3 is half the input level to the port 1, for example, this directional coupler serves as a distributor which equally distributes the input received in the port 1 to the ports 2 and 3 while a signal at the port 3 regularly delays that at the port 2 by a signal phase angle of 90° in this case. Referring to FIG. 5, the stripline electrodes 40*a* and 41*a* are shielded by ground electrodes 40*b* and 41*b*, shown in two-dot chain lines, which are arranged to hold the stripline electrodes 40*a* and 41*a* from upper and lower directions while being insulated from the same.

A well-known directional coupler of such a broadside coupling type is formed by providing striplines on both surfaces of a resin substrate, arranging resin substrates on upper and lower portions thereof and compression-bonding the same through jointing materials, further holding this substance from upper and lower directions by ground plane metal plates, and connecting these layers with each other by screws of the like.

In a digital portable telephone or the like, such a directional coupler is applied to a 90° phase converter or distributor of a phase modulation circuit by utilizing such a 90° phase converting function or distributing function, as a directional coupler 50 shown in FIG. 6. When an output signal of a local oscillator 51 is inputted through a port 1 (corresponding to the port 1 in FIG. 5) of the directional coupler 50, ports 2 and 3 output signals of the same level which are 90° out of phase with each other, and these signals are inputted in mixers 52*a* and 52*b* as seen in FIG. 6 respectively. The mixers 52*a* and 52*b* as seen in FIG. 6 phase-modulate the local signals by 180° with I and Q pulsing signals respectively. When the modulation outputs are combined with each other in a combiner, the local signals are subjected to four type of phase modulations of 0°, 90°, 180° and 270°.

However, the aforementioned portable telephone has an important subject of miniaturization, and hence further miniaturization is required also for a 90° shifter comprised of the directional coupler. The stripline electrode requires a length of $\lambda/4$, e.g., 7.5 cm at 1 GHz with a dielectric constant of 1, as hereinabove described. In order to couple linear stripline electrodes having such lengths a substrate having a relatively large volume is required. In the broadside coupling type directional coupler shown in FIG. 5, the coupled lines are positioned along the vertical direction. If the coupled lines are superposed with a plurality of substrates and screwed, therefore, miniaturization of the directional coupler is limited and the cost is increased.

SUMMARY OF THE INVENTION

In consideration of the aforementioned circumstances, an object of the present invention is to provide a further miniaturized chip type directional coupler.

A chip type directional coupler according to the present invention comprises a laminated structure having two dielectric substrates, each provided with a quarter-wavelength stripline electrode formed in a meandering shape on one major surface thereof, which are so stacked as to electromagnetically couple the stripline electrodes with each other; and two substrates, each provided with a ground electrode on at least one major surface thereof, which are directly or indirectly stacked on both sides of the two dielectric substrates for hold the same, and a plurality of external electrodes provided on side surfaces of the laminated structure. Respective end portions of the stripline electrodes and the ground electrodes are electrically connected to different ones of the external electrodes.

The term "meander" described above is used herein to cover not only a shape combining curves such as the shape of snake but also a shape combining line segments such as a zigzag shape resembling lightning.

According to the aforementioned structure, the quarter-wavelength stripline electrode portions are formed nonlinearly in a meandering shape so that whole portions can be formed on smaller substrates, as compared with a structure having linear electrode portions, whereby the chip type directional coupler can be miniaturized. Further, the ground electrodes are adapted to vertically hold or enclose the stripline electrodes for shielding the same from upper and lower directions, whereby an electromagnetic shielding structure can be implemented by the laminated structure with no requirement for a metal case etc. Further, the chip type directional coupler can be surface-mounted on a substrate, since the external electrodes are formed on its side surfaces.

The foregoing and other objects, features, aspects and advantages of the present invention will become more apparent from the following detailed description off the present invention when taken in conjunction with the accompanying drawings.

DESCRIPTION OF THE PREFERRED EMBODIMENTS

An embodiment of the present invention is now described with reference to FIGS. 1 to 4C.

Figure 1:
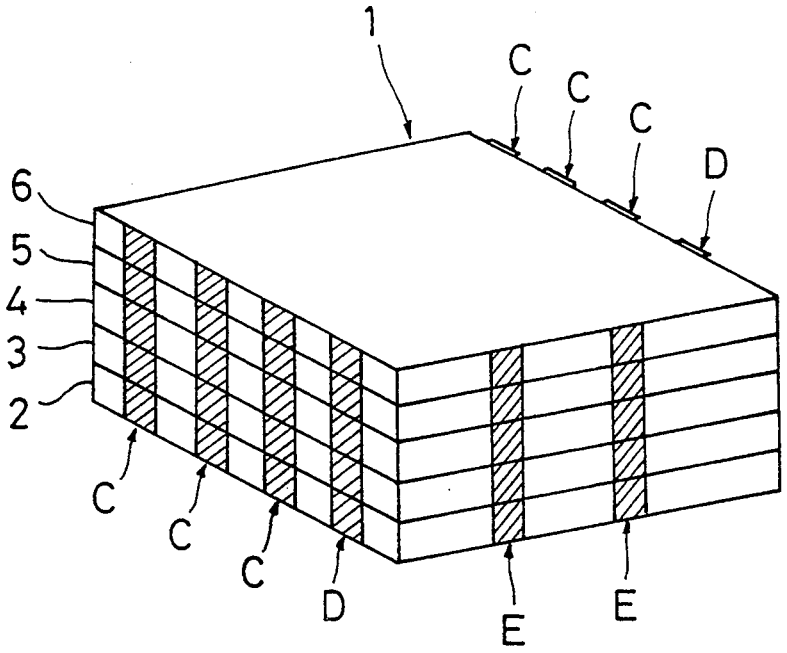
FIG. 1 is a perspective view showing a chip type directional coupler according to an embodiment of the present invention.

FIG. 1 is a perspective view showing the appearance of a chip type directional coupler 1. This chip type directional coupler 1 has a laminated structure which is formed by stacking a first ground electrode substrate 2, a first stripline electrode substrate 3, a second stripline electrode substrate 4, a second ground electrode substrate 5, and a protective substrate 5. This laminated structure is provided on its side surfaces with external electrodes C, D and E for ground electrodes, a principal line and a secondary line respectively. The substrates 2 to 6 are formed of ceramic green sheets, in practice. The ceramic green sheets are first provided with respective electrode films on major surfaces thereof, and then stacked with each other. The as-obtained green laminate is provided with the external electrodes C, D and E on its side surfaces, and thereafter sintered to form the coupler 1. In practice, therefore, no separation lines appear between the layers of the respective substrates 2 to 6 shown in FIG. 1. The external electrodes C, D and E may be formed by applying conductive paste to the laminate and baking the same, or by performing plating or evaporation after firing the laminate of the ceramic sheets.

Figure 2:
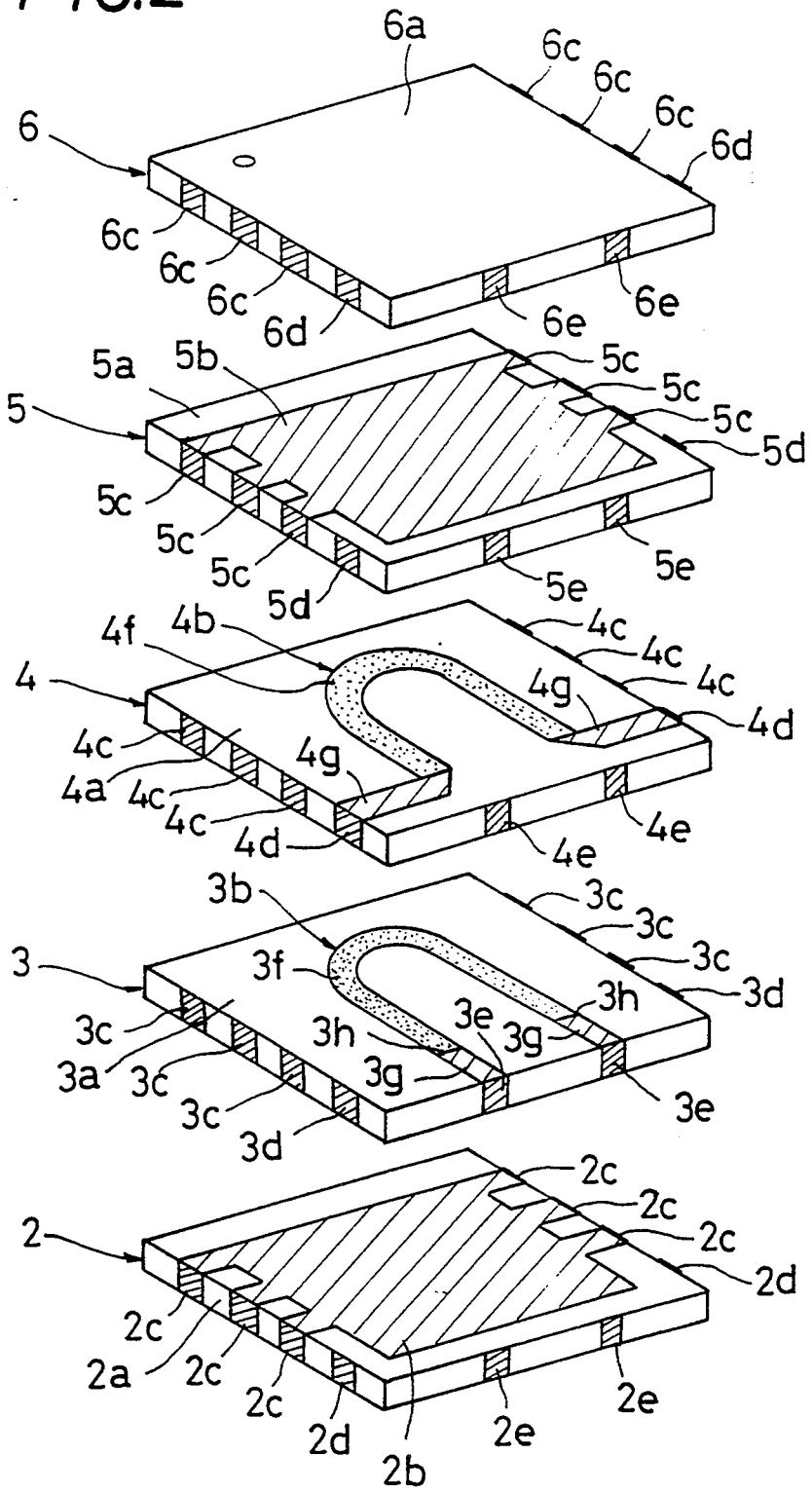
FIG. 2 is an exploded perspective view illustrating respective substrates in the chip type directional coupler shown in FIG. 1.

As understood from FIG. 2 showing an exploded perspective view of the directional coupler 1 shown in FIG. 1, the first ground electrode substrate 2 is formed by a square ceramic substrate 2*a* and a ground electrode 2*b* provided on one major surface thereof. The ground electrode 2*b* is sized to be capable of covering a U-shaped quarter-wavelength stripline electrode portion 3*f* as described later. This ground electrode 2*b* is not formed over the entire major surface of the ceramic substrate 2*a*. In other words, the ground electrode 2*b* is not formed on a peripheral edge portion of the substrate 2*a*, to be prevented from electrical connection with external electrodes 2*d* and 2*e* as described below. The ceramic substrate 2*a* is provided on its side surfaces with external electrodes 2*c*, 2*d* and 2*e*. The ground electrode 2*b* is extended toward the external electrodes 2*c*, while the external electrodes 2*d* and 2*e* are not electrically connected with the ground electrode 2*b*, as described above.

The first stripline electrode substrate 3 is formed by a square ceramic substrate 3*a* and a stripline electrode 3*b* (secondary line) provided on one major surface thereof. This stripline electrode 3*b* is formed by a substantially U-shaped quarter-wavelength stripline electrode portion 3*f*, lead electrode portions 3*g* which are connected to external electrode portions 3*e* as described later, and intermediate portions 3*h* connecting the lead electrode portions 3*g* with both end portions of the quarter-wavelength stripline electrode portion 3*f*. The intermediate portions 3*h* are adapted by tapering (not shown), to impedance-match the stripline electrode portion 3*f* with the lead electrode portions 3*g*. Further, external electrode portions 3*c*, 3*d* and 3*e* corresponding to the aforementioned external electrode portions 2*c*, 2*d* and 2*e* are positioned on the side surfaces of the ceramic substrate 3*a* respectively. The quarter-wavelength stripline electrode portion 3*f* is formed to define a large U shape in the range of the ground electrode 2*b* as close as possible along its peripheral edge portion.

The second stripline electrode substrate 4, which is substantially similar in structure to the first stripline electrode substrate 3, has a square ceramic substrate 4*a*, a stripline electrode 4*b* (principal line), a U-shaped quarter-wavelength stripline electrode portion 4*f*, lead electrode portions 4*g*, and external electrode portions 4*c*, 4*d* and 4*e*. The lead electrode portions 4*g* are bent in a direction for avoiding grade separation with the lead electrode portions 3*g*, and connected with the external electrode portions 4*d*.

The second ground electrode substrate 5, which is identical in structure to the second ground electrode substrate 2, has a square ceramic substrate 5*a*, a ground electrode 5*b*, and external electrode portions 5*c*, 5*d* and 5*e*.

The protective substrate 6 is formed by a square ceramic substrate 6*a*, which is provided on its side surfaces with external electrode portions 6*c*, 6*d* and 6*e* corresponding to the external electrode portions 2*c*, 2*d* and 2*e* respectively. The external electrode portions of the respective substrates 2 to 6 are stacked and compression-bonded to each other. Therefore, the external electrodes C for the ground electrodes are defined by the external electrode portions 2*c*, 3*c*, 4*c*, 5*c* and 6*c*, the external electrodes D for the principal line are defined by the external electrode portions 2*d*, 3*d*, 4*d*, 5*d* and 6*d*, and the external electrodes E for the secondary line are defined by the external electrode portions 2*e*, 3*e*, 4*e*, 5*e* and 6*e* respectively, as shown in FIG. 1.

According to the aforementioned structure, the quarter-wavelength stripline electrode portions 3*f* and 4*f* of the first and second stripline electrode substrates 3 and 4 which are held between the first and second ground electrode substrates 2 and 5 approach each other in grade separation, thereby forming the directional coupler 1.

The quarter-wavelength stripline electrode portions 3*f* and 4*f* are so nonlinearly formed that the same can be provided on smaller substrates as compared with linear ones, whereby the chip type directional coupler 1 can be miniaturized. Further, the ground electrodes 2*a* and 5*a* are arranged to hold the two stripline electrodes 3*b* and 4*b* for shielding the same from upper and lower directions, whereby an electromagnetic shielding structure can be implemented by the laminated structure with no requirement for a metal case etc. In addition, the external electrodes C, D and E are formed on the side surfaces of the laminate, to enable surface mounting of the directional coupler 1 on a substrate.

A method of manufacturing the aforementioned chip type directional coupler 1 is now briefly described. First, two green sheets provided with strip conductors are vertically superposed with each other and then held by green sheets printed with ground electrodes from upper and lower directions. Then a green sheet for serving as a protective substrate is stacked on this substance, and the as-formed laminate is integrally fired after application of respective external electrode materials. Such external electrodes may alternatively be formed after the firing step, as a matter of course.

Figure 3:
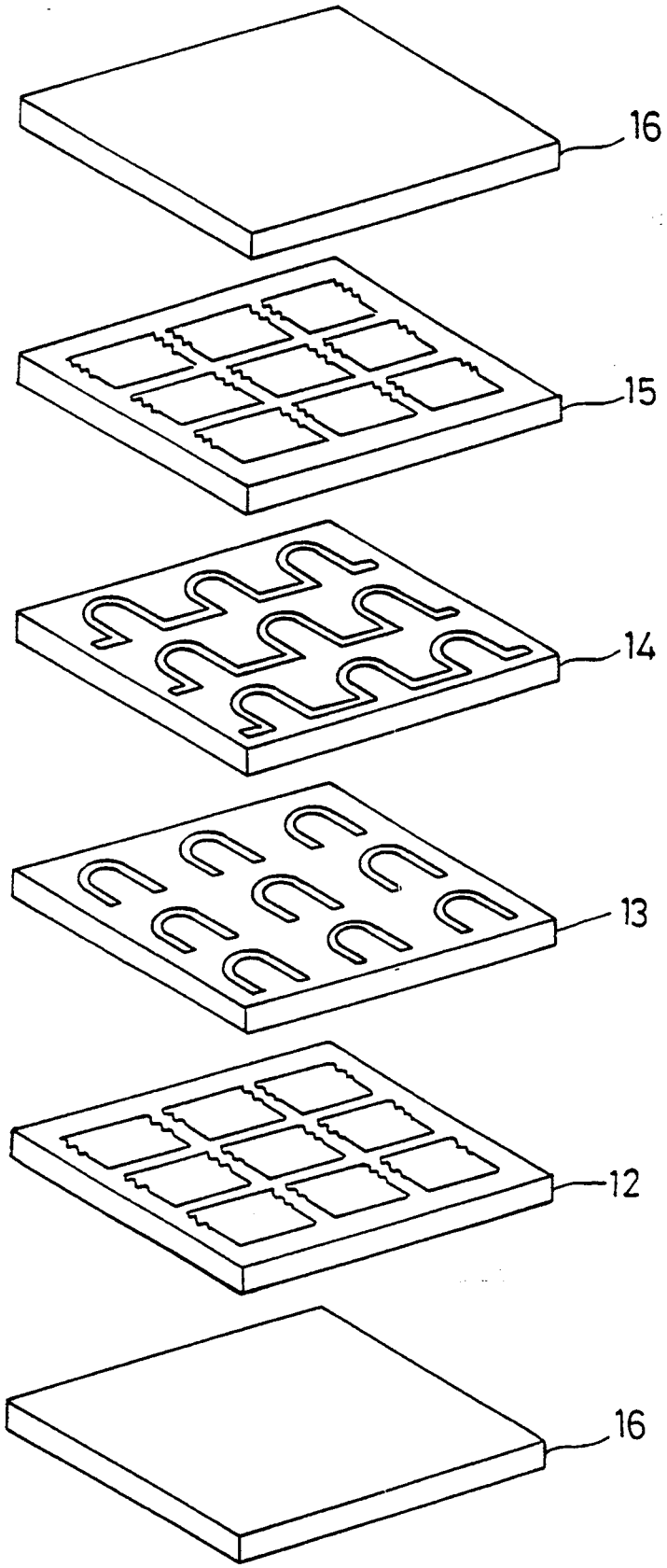
FIG. 3 is a perspective view showing respective substrates employed for mass-producing chip type directional couplers.
Figure 4A:
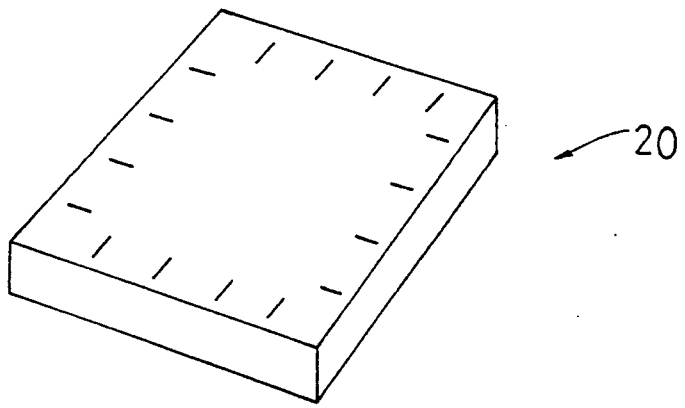
FIG. 4A is a perspective view illustrating a laminated substrate formed by the substrates shown in FIG. 3.
Figure 4B:
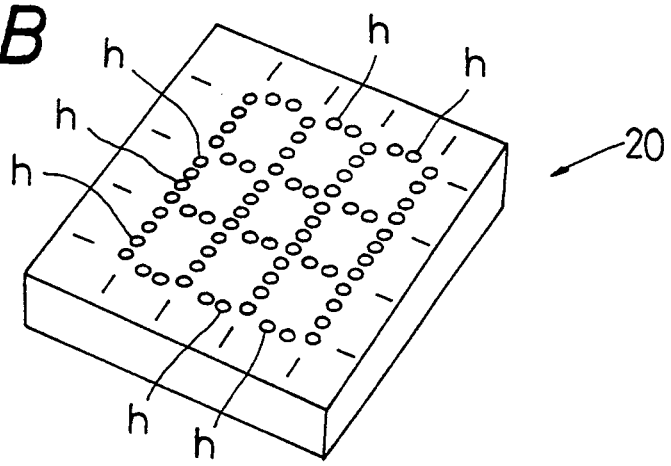
FIG. 4B is a perspective view showing a state of the laminated substrate provided with through holes.
Figure 4C:
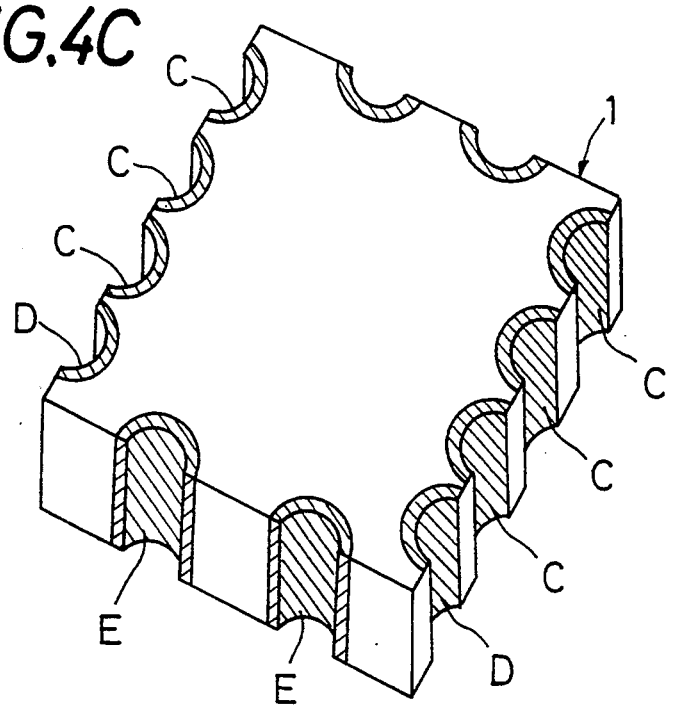
FIG. 4C is an enlarged perspective view showing one of a plurality of chip type directional couplers obtained by cutting the laminated substrate shown in FIG. 4B along prescribed cutting lines after injecting a metal into the through holes.
Figure 5:
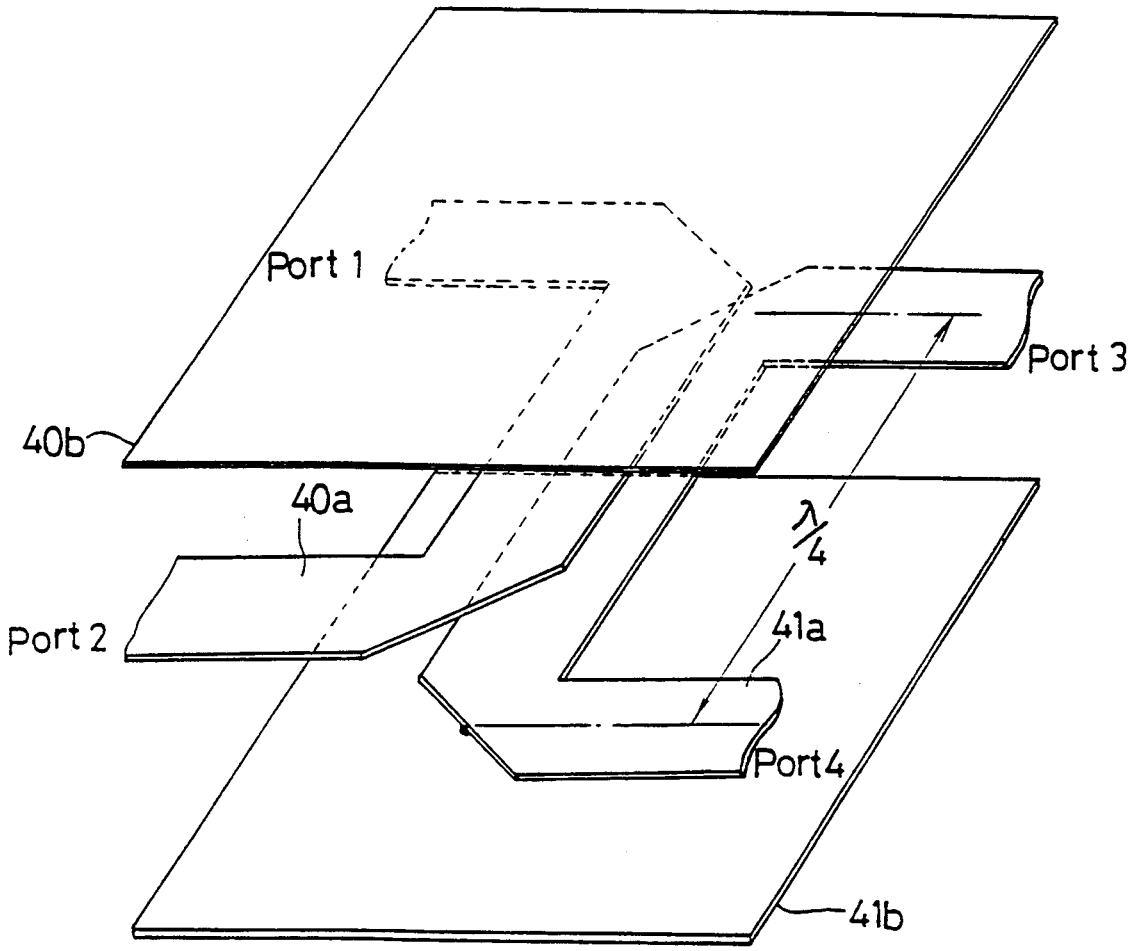
FIG.5 PRIOR ART
FIG. 5 is a perspective view showing a conventional broadside coupling type directional coupler.
Figure 6:
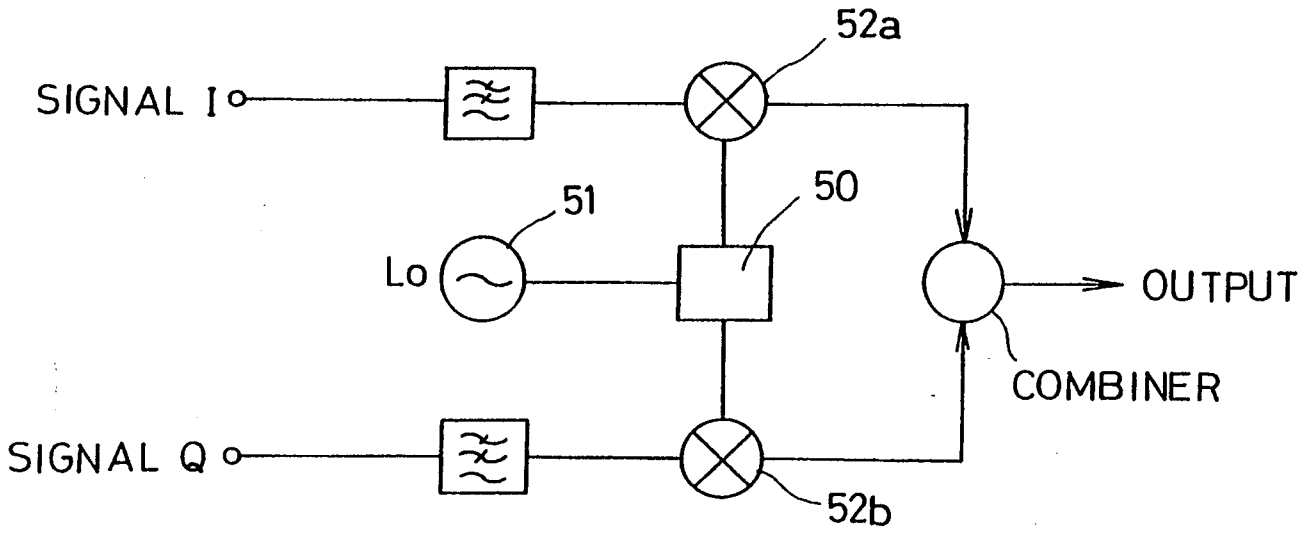
FIG. 6 is a block diagram showing a quadrature modulation circuit employing a directional coupler.

While the directional substrates may be prepared from either resin or ceramic substrates, ceramic can suppress power loss of the principal line since the same has smaller dielectric loss than glass epoxy resin etc. as described below, and is excellent in heat radiation for attaining further miniaturization.

glass epoxy resin; tan $\delta=0.02$ exemplary ceramic dielectric: tan $\delta=0.0007$ Such chip type directional couplers can be mass-produced in the following manufacturing method: As shown in FIG. 3, a substrate 12 made of a green sheet and provided with a plurality of ground electrodes, a substrate 13 made of a green sheet and provided with a plurality of stripline electrodes (secondary lines), a substrate 14 made of a green sheet and provided with a plurality of stripline electrodes (principal lines), a substrate 15 made of a green sheet and printed with a plurality of ground electrodes and a pair of substrate 16 made of green sheets for defining protective substrates are stacked to obtain a mother laminated substrate 20 shown in FIG. 4A. Then, through holes h are formed in portions for defining external electrodes and other pairs of portions (the pairs of portions are adapted to improve junction strength between the respective substrates) as shown in FIG. 4B, and a metal for defining electrodes is injected into the through holes h. Thereafter the mother laminated substrate 20 is cut along prescribed cutting lines, and each cut piece fired obtain a chip type directional coupler 1 having external electrodes C, D and E on its side surfaces, as shown in FIG. 4C.

While the degree of coupling and the characteristic impedance in a quarter-wavelength stripline electrode portion depends on the dielectric constant, film thickness, line width and line spacing, such line spacing can be easily adjusted by interposing a non-printed sheet of a prescribed width between substrates since the inventive chip type directional coupler has a laminated structure.

Although the present invention has been described and illustrated in detail, it is clearly understood that the same is by way of illustration and example only and is not to be taken by way of limitation, the spirit and scope the present invention being limited only by the terms of the appended claims.

What is claimed is:

1. A chip type directional coupler comprising:

a laminated structure comprising a plurality dielectric sheets including:

two dielectric substrates, each being provided with a curved quarter-wavelength stripline electrode on one major surface thereof, each said stripline electrode being located in said laminated structure so as to electromagnetically couple said stripline electrodes with each other, and two substrates each being provided with a ground electrode on at least one major surface thereof, being stacked on both sides of said two dielectric substrates; and a plurality of external electrodes formed on side surfaces of said laminated structure, respective end portions of said stripline electrodes and said ground electrodes being electrically connected to different ones of said external electrodes, wherein said plurality of dielectric sheets comprise at least one additional dielectric sheet disposed between a stripline electrode and a ground electrode.

2. A chip type directional coupler in accordance with claim 1, wherein said laminated structure comprises a co-fired sintered body prepared by stacking a plurality of ceramic green sheets for forming said dielectric substrates and said substrates provided with said ground electrodes and firing the laminate.

3. A chip type directional coupler in accordance with claim 2, wherein said ground electrodes are so sized as to cover said quarter-wavelength stripline electrodes as viewed along the perpendicular direction of said laminated structure.

4. A chip type directional coupler in accordance with claim 2, wherein said stripline electrodes formed on said two dielectric substrates are connected to external electrodes on different side surfaces of said laminated structure.

5. A chip type directional coupler in accordance with claim 2, wherein said curved stripline electrodes are substantially U-shaped.

6. A chip type directional coupler in accordance with claim 2, wherein said laminated structure further comprises protective substrates arranged on outer sides of said two substrates provided with ground electrodes.

7. A chip type directional coupler in accordance with claim 1, wherein said ground electrodes are so sized as to cover said quarter-wavelength stripline electrodes as viewed along the perpendicular direction of said laminated structure.

8. A chip type directional coupler in accordance with claim 1, wherein said stripline electrodes formed on said two dielectric substrates are connected to external electrodes on different side surfaces of said laminated structure.

9. A chip type directional coupler in accordance with claim 1, wherein said curved stripline electrodes are substantially U-shaped.

10. A chip type directional coupler in accordance with claim 1, wherein said laminated structure further comprises protective substrates arranged on outer sides of said two substrates provided with said ground electrodes.

11. A chip type directional coupler in accordance with claim 1, wherein said dielectric substrates are made of ceramics.

12. A chip type directional coupler in accordance with claim 1, wherein at least one additional dielectric sheet is disposed between each said stripline electrode and a respective ground electrode.

13. A chip type directional coupler in accordance with claim 12, wherein a plurality of additional dielectric sheets are disposed between each said stripline electrode and said respective ground electrode.

14. A chip type directional coupler in accordance with claim 13, wherein said plurality of additional dielectric sheets has a predetermined thickness which is selected so as to provide said chip type directional coupler with a desired characteristic.

15. A chip type directional coupler comprising:

a laminated structure comprising a plurality of dielectric ceramic sheets including:

two dielectric substrates, each being provided with a curved quarter-wavelength stripline electrode on one major surface thereof, said curved electrodes being located in said laminated structure as to electromagnetically couple said stripline electrodes with each other, and two substrates each being provided with a ground electrode on at least one major surface thereof, being stacked on both sides of said two dielectric substrates; and a plurality of external electrodes formed on side surfaces of said laminated structure, respective end portions of said stripline electrodes and said ground electrodes being electrically connected to different ones of said external electrodes;

wherein said plurality of dielectric ceramic sheets includes a plurality of additional dielectric ceramic sheets disposed between each said stripline electrode and a respective ground electrode.

16. A chip type directional coupler in accordance with claim 15, wherein said plurality of additional dielectric sheets has a predetermined thickness which is selected so as to provide said chip type directional coupler with a desired characteristic.

* * * * *